US008220760B2

(12) United States Patent
Fetzer et al.

(10) Patent No.: US 8,220,760 B2
(45) Date of Patent: Jul. 17, 2012

(54) HOUSEHOLD APPLIANCE HAVING A HEIGHT-ADJUSTING DEVICE FOR AN APPLIANCE PEDESTAL

(75) Inventors: Gerhard Fetzer, Gundelfingen (DE); Manfred Seeβle, Gerstetten (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 12/743,375

(22) PCT Filed: Oct. 29, 2008

(86) PCT No.: PCT/EP2008/064639

§ 371 (c)(1),
(2), (4) Date: May 18, 2010

(87) PCT Pub. No.: WO2009/068399

PCT Pub. Date: Jun. 4, 2009

(65) Prior Publication Data

US 2010/0276564 A1 Nov. 4, 2010

(30) Foreign Application Priority Data

Nov. 29, 2007 (DE) ..... 10 2007 057 511

(51) Int. Cl.
*F16M 11/24* (2006.01)

(52) U.S. Cl. ..... 248/188.4; 248/188.2; 248/188.8; 248/677; 248/422

(58) Field of Classification Search ..... 248/188.8, 248/188.4, 188.2, 677, 678, 422, 188.5; 254/296, 254/343; 74/84 R, 412 R, 416, 425; 108/147, 108/144.11; 312/351.1
See application file for complete search history.

(56) References Cited

U.S. PATENT DOCUMENTS

| | | | | |
|---|---|---|---|---|
| 1,417,639 | A * | 5/1922 | Sterner | 248/188.4 |
| 4,380,276 | A * | 4/1983 | Sweet et al. | 188/79.55 |
| 4,991,805 | A * | 2/1991 | Solak et al. | 248/188.4 |
| 5,179,990 | A * | 1/1993 | Marocco | 160/176.1 V |
| 5,967,472 | A * | 10/1999 | Wilhelmstatter et al. | 248/188.4 |
| 6,550,567 | B2 * | 4/2003 | Murakami et al. | 180/444 |
| 2002/0184760 | A1 * | 12/2002 | Babin et al. | 29/888 |
| 2007/0205342 | A1 * | 9/2007 | Gabriel | 248/188.4 |

FOREIGN PATENT DOCUMENTS

| | | | |
|---|---|---|---|
| DE | 19528901 | A1 | 2/1997 |
| EP | 1103206 | A1 | 5/2001 |
| WO | 2004107914 | A1 | 12/2004 |

* cited by examiner

*Primary Examiner* — Terrell McKinnon
*Assistant Examiner* — Ingrid M Weinhold
(74) *Attorney, Agent, or Firm* — James E. Howard; Andre Pallapies

(57) ABSTRACT

A household appliance, particularly a dishwasher or washing machine, having a height-adjusting device for an appliance pedestal. The height-adjusting device may include at least one drive gear engaged with a transmission drive converting the rotary motion of the drive gear into a lift motion of the appliance pedestal. In an exemplary embodiment of the invention, the drive gear includes a torque-limiting element operable to enable a deflecting motion of the drive gear from an operating position when a limit torque is exceeded, and which releases the engagement between the drive gear and the transmission drive.

22 Claims, 4 Drawing Sheets

SECTION VIEW I - I

SECTION VIEW II - II

HOUSEHOLD APPLIANCE HAVING A HEIGHT-ADJUSTING DEVICE FOR AN APPLIANCE PEDESTAL

BACKGROUND OF THE INVENTION

The invention relates to a household appliance having a height-adjusting device for an appliance pedestal.

Built-in kitchen appliances which are already built in can be brought into the right mounting position by means of height-adjustable appliance pedestals, the height of the inaccessible rear appliance pedestals being adjusted by means of an adjusting rod which can be actuated on the front of the appliance.

A generic height-adjusting device for an appliance pedestal of a household appliance is known from WO 2004/107914 A1, in which a drive gear engages with a transmission gear which converts the rotational motion of the drive gear into a lift motion of the appliance pedestal.

Specifically, in WO 2004/107914 A1 the drive gear is a drive worm which rests in a rotatably fixed manner on an adjusting rod and is mounted in a fixed position and rotatably in a mounting housing at the rear of the appliance. The drive worm engages with a worm wheel which is in threaded engagement with an appliance pedestal threaded shank. The threaded shank has an end stop. This secures the gearbox against overload and prevents an excessive lift motion. To this end the end stop is designed such that the worm wheel jumps back by one thread pitch of the threaded shank when it reaches the end stop. The design of the end stop on the threaded shank is complex in terms of components and of manufacturing.

BRIEF SUMMARY OF THE INVENTION

The object of the invention is to provide a household appliance with a height-adjusting device which is secured in simple manner against an overload.

The invention is based on a household appliance, in particular a dishwasher or washing machine, having a height-adjusting device for an appliance pedestal which has at least one drive gear which engages with a transmission drive converting the rotary motion of the drive gear into a lift motion of the appliance pedestal.

According to the characterizing part of claim 1, the drive gear is associated with a torque-limiting element permitting a deflecting motion of the drive gear from its operating position when a limit torque is exceeded, said torque-limiting element releasing the engagement between the drive gear and the transmission gear. As a result an engagement between the drive gear and a transmission drive element engaging therewith is released at least in the short term. As a result of the deflecting motion the drive gear—in respect of the transmission drive element—can jump at least one pitch, as a result of which the teeth of the drive gear and of the transmission drive element are disengaged.

The deflecting motion of the drive gear can thus occur when a permissible maximum torque is exceeded. The permissible maximum torque is to be determined depending on the structural design of the torque-limiting element and also as a function of the latter's material strength. The permissible maximum torque is in this case to be designed so that the drive gear, the transmission drive and/or a shaft or adjusting rod driving the drive gear are not damaged. With the inventive torque-limiting element, as in the case of a slip clutch, when the maximum torque is exceeded the drive gear is briefly disengaged, so that it rotates without load and no torque is supplied to the transmission drive. If the torque initiated is less than the limit torque, the drive gear re-engages with the transmission drive.

The inventive torque-limiting element reliably limits the torque not only if the appliance pedestal shank of the height-adjusting device is moved against an end stop, as is the case in the prior art. Rather, it is inventively ensured that the torque is limited across the entire adjustment range of the appliance pedestal shank.

The inventive height-adjusting device can in particular be used for rear appliance pedestals in the case of built-in appliances. The height-adjusting device can be used to raise the inaccessible rear area of the built-in appliance, until the household appliance reaches the right height position. In particular when using plastic components for the height-adjusting device there is a risk in the prior art that torques are initiated as a result of a manual actuation of the height-adjusting device and may result in the destruction of the plastic component.

As already mentioned, the inventive height-adjusting device can in particular be used with rear appliance pedestals of built-in appliances. In this case the height is adjusted using an actuation element provided on the front of the household appliance. The actuation element rests on an adjusting rod which extends as far as the height-adjusting device disposed at the rear. The rear end of the adjusting rod can bear the drive gear, for example a worm gear, which in turn engages with a worm wheel of the transmission drive. The driven gear or worm wheel is mounted in a fixed position in a bearing housing and has an internal thread which engages with an external thread of the appliance pedestal shank. When the driven gear rotates, this therefore results in a lift motion of the appliance pedestal. The threaded shank is disposed in a bearing bush of the bearing housing. In order to avoid a rotary motion of the appliance pedestal shank, the latter can have at least one external flat area which engages in form-fit manner with the bearing bush.

According to the invention the drive gear is designed such that when torque is transmitted to the transmission drive between the drive gear and the driven gear of the transmission drive a deflection force is generated, with which the drive gear is pressed against the torque-limiting element. In this case the limiting element can be designed to elastically deflect. The aforementioned deflection force is generated by appropriately angled teeth of the drive gear and/or of the driven gear, in particular by a drive worm and a worm wheel as an output element.

While torque is being transmitted the drive gear hence exerts a deflection force on the torque-limiting element. If the deflection force is too great, the torque-limiting element yields elastically, as a result of which the deflecting motion of the drive gear occurs. In this way the drive gear skips the teeth of the driven gear, whereupon the elastically rebounding torque-limiting element re-engages the drive gear with the driven gear. This skipping of the teeth can be perceived as a juddering noise, so that the user is made aware that the household appliance has hit against a stop, for instance an upper kitchen worktop.

In order to reduce components, it is preferred if the torque-limiting element is simultaneously a housing part of a drive housing, in which the drive gear is rotatably mounted. The limiting element is thus integrated into the housing, which thus assumes the dual function of mounting and also of limiting the torque of the drive gear.

The torque-limiting element can either be brought directly into contact with the drive gear, or can alternatively be brought into contact with a shaft driving the drive gear. For a compact design of the height-adjusting device it is preferred if the torque-limiting element can be brought directly into contact with the gear wheel outer contour of the drive gear.

As already mentioned above, the torque is preferably transmitted using a worm gear as a drive gear, which engages with a worm wheel of the transmission drive. The axis of rotation of the drive worm can here run perpendicular to the axis of rotation of the worm wheel.

In manufacturing terms it is simple if the torque-limiting element is manufactured from the same material and/or in a single piece with a mounting base of the household appliance. The mounting base is used to brace appliance units. It can be manufactured together with the torque-limiting element as a plastic injection-molded component. The compensating motion of the drive worm can in this case take place in a transverse direction to the axis of rotation of the worm wheel.

For the torque to be reliably limited, a corresponding motion control of the drive worm in the direction of the torque-limiting element is necessary. To this end the drive worm can be associated with a height stop, with which the deflecting motion of the drive worm is guided in the direction of the torque-limiting element in the event of an overload. To design such a height stop the drive worm can be extended with a bearing pin which is guided in a bearing opening in the manner of a sliding block guide. The bearing opening can in particular be a slot which extends in the direction of the torque-limiting element. The displacement path provided by the slot for the drive worm is in this case dimensioned such that the drive worm can disengage from the worm wheel if the deflection force is correspondingly large.

When the height-adjusting device is at rest, in other words not in an actuated state, the torque-limiting element can be approximately in contact with the outer contour of the drive worm. This guarantees that the drive worm is mounted free of play.

The torque-limiting element can preferably be a spring rib. Such a spring rib has a downward projecting free end which can already be easily designed in manufacturing terms to be elastically deflectable with little expenditure of energy.

BRIEF DESCRIPTION OF THE DRAWINGS

An exemplary embodiment of the invention is shown below on the basis of the enclosed figures.

The figures show:

FIG. 3 an enlarged partial sectional view along the cutting plane II-II from FIG. 1; a.

DETAILED DESCRIPTION OF EXEMPLARY EMBODIMENTS OF THE PRESENT INVENTION

Figure 1:
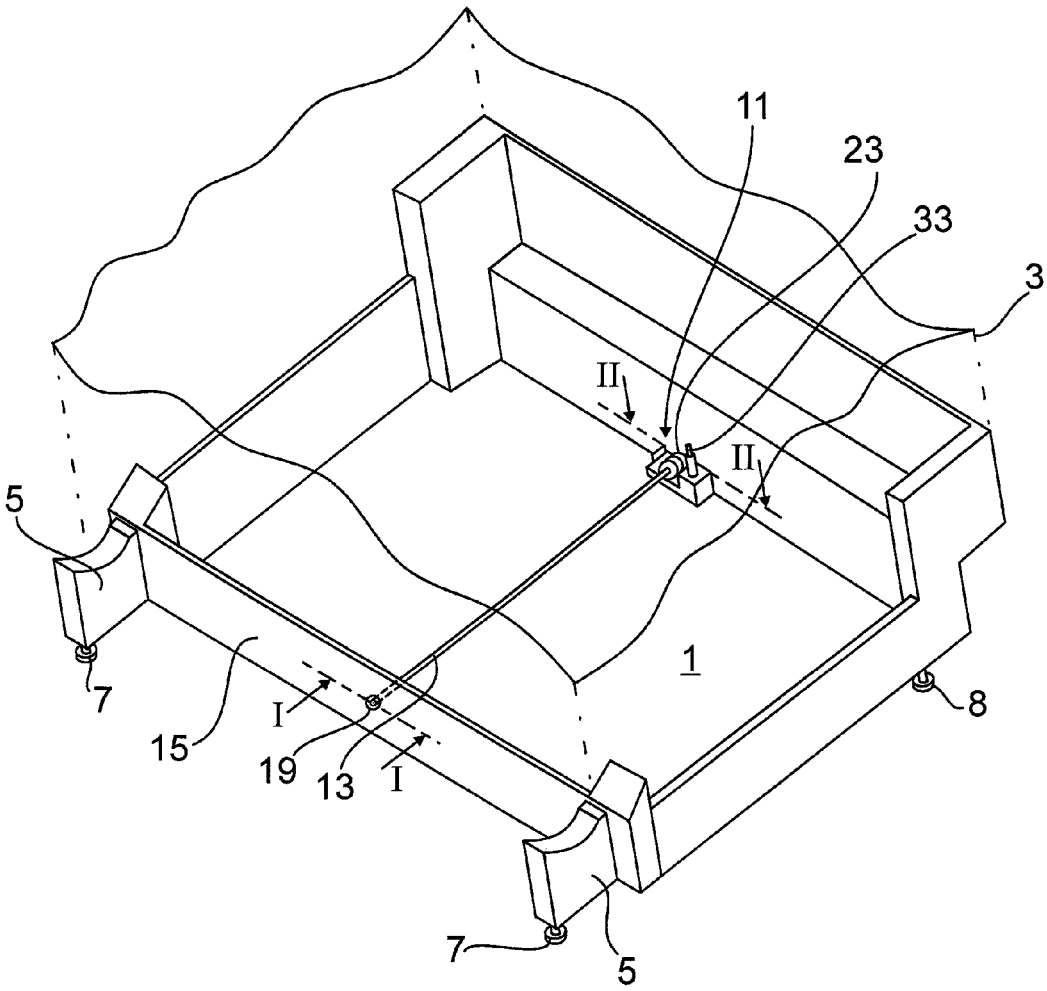
FIG. 1 a perspective view of a mounting base of a household appliance.
Figure 3:
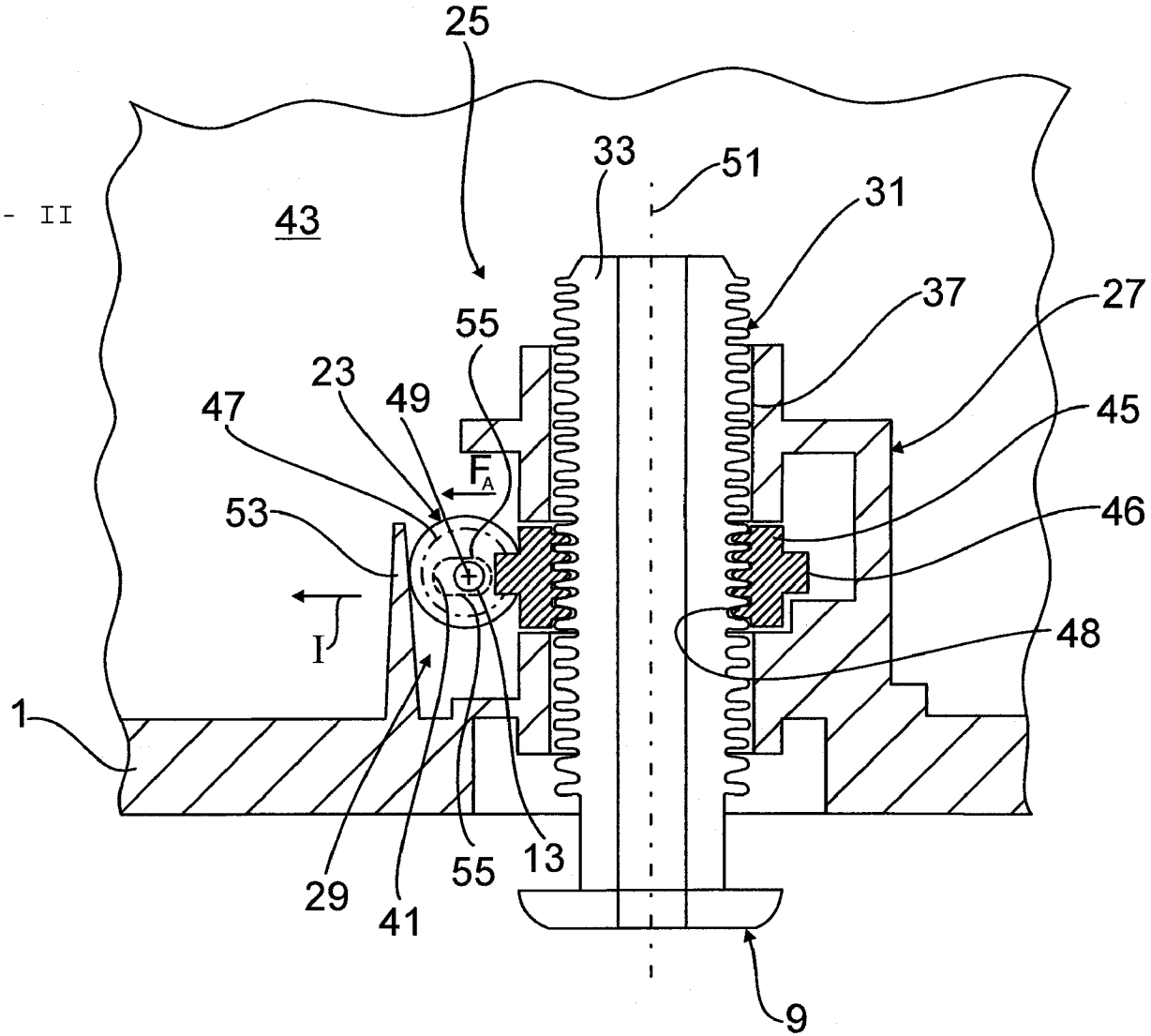

FIG. 1 shows a mounting base 1, manufactured as a plastic injection-molded component, of a household appliance 3 which is merely indicated. The appliance units provided for in the household appliance 3 are omitted for reasons of clarity. The mounting base 1 has two lateral support arms 5 projecting forward and downward on the front, with front appliance pedestals 7. In addition, in the rear area of the mounting base 1 a height-adjustable appliance pedestal 9 is provided approximately centrally, as is shown in FIG. 3. In contrast, in FIG. 1 merely the height-adjusting device 11 of the central appliance pedestal 9 is visible. The height-adjusting device 11 is described later.

Figure 2:
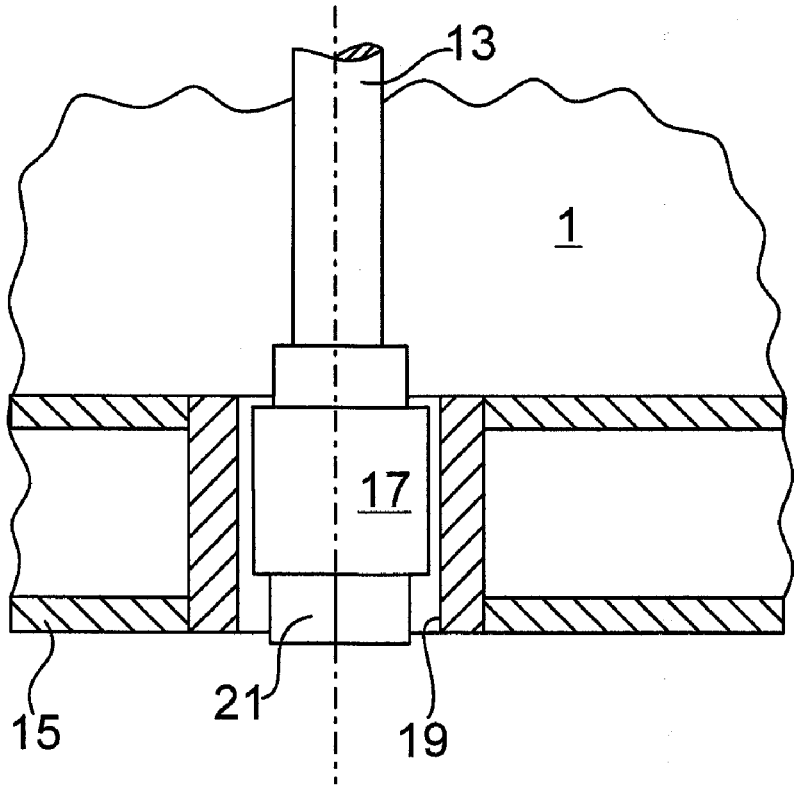
FIG. 2 an enlarged sectional view from above of a front actuation element of the height-adjusting device along the cutting plane I-I.

As further emerges from FIG. 1, the height-adjusting device 11 is associated with an adjusting rod 13 which extends as a drive shaft as far as the front 15 of the mounting base 1. The front end of the adjusting rod 13 has an adjusting bush 17 according to FIG. 2 which is rotatably mounted in a bearing opening 19 of the front 15 of the mounting base embodied here as being double-walled. The adjusting bush 17 of the adjusting rod 13 is provided at the front with a tool kit 21 with which the adjusting rod 13 can be rotatably actuated.

The rear end of the adjusting rod 13 has a drive connection to the height-adjusting device 11. To this end a drive worm 23 rests on the rear end of the drive rod 13 in a rotatably fixed manner as a drive gear and engages with a transmission drive 25 of the height-adjusting device 11. The transmission drive 25 converts a rotary movement of the drive worm 23 into a linear lift motion of the appliance pedestal 9. According to FIG. 3 the transmission drive 25 has a gear case 27 molded in one piece on the mounting base 1. The gear case 27 is divided into a worm case 29 and an essential hollow cylindrical shank housing 31. In the shank housing 31 a threaded shank 33 of the appliance pedestal 9 is disposed in a height-adjustable and rotatably fixed manner. For the rotatably fixed arrangement the threaded shank 33 has a flat area 35 shown in FIG. 4 in the external thread of the threaded shank 33. Corresponding to this flat area 35 the shank channel 37 of the shank housing 31 is also flattened, so that the threaded shank 33 can merely move in the vertical direction, but not in a rotary direction.

Figure 4:
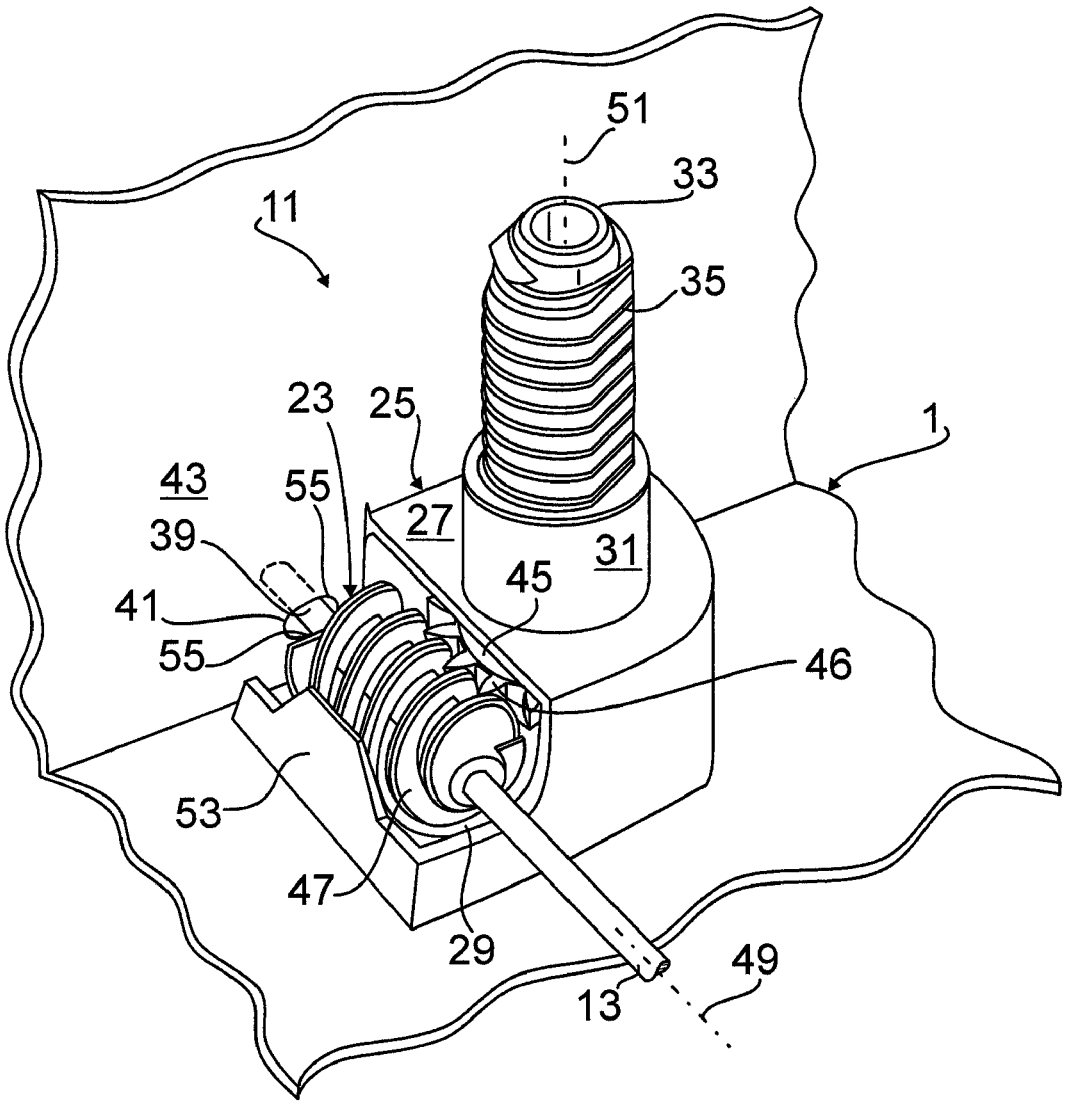
FIG. 4 a detailed perspective view of the height-adjusting device.

As emerges from FIG. 4, the drive worm 23 is extended with a bearing pin 39 which is rotatably mounted in a slot 41 in the rear wall 43 of the mounting base. Between the drive worm 23 and the threaded shank 33 of the appliance pedestal 9 is a worm wheel 45. The external gear wheels 46 of the worm wheel 45 engage with the helical worm spiral 47 of the drive worm 23. The worm wheel 45 also has an internal thread 48 on the inside, which engages with the external thread of the threaded shank 33. According to FIG. 3 the shank channel 37 is divided in two in the vertical direction. The worm wheel 45 is disposed between the two channel sections and is screwed to the threaded shank 33.

The axis of rotation 49 of the drive worm 23 extends according to the figures horizontally in the depth direction, while the axis of rotation 51 of the threaded shank 33 runs perpendicular thereto.

The worm case 29 is bounded laterally by a torque-limiting element 53. The torque-limiting element 53 is here a spring rib which is molded onto the mounting base 1 and whose top end can move freely. In the non-actuated state of the height-adjusting device 11 and in an operating position the drive worm 23 is disposed essentially without play between the spring rib 47 of the worm case section 29 and the worm wheel 45.

FIGS. 3 and 4 show the normal operating position of the height-adjusting device 11. Therefore the drive worm 23 is engaged with the worm wheel 45. When the drive rod 13 is rotationally actuated the worm wheel 45 is thus rotated via the drive worm 23, as a result of which a lift motion of the appliance pedestal 9 occurs in the vertical direction.

By means of the spring rib 53 the torque is limited, providing a torque exerted on the height-adjusting device 11 exceeds a limit torque. An overload such as this occurs, in deviation from normal operation, if the rear area of the appliance for instance hits against a kitchen worktop as a result of the height of the rear appliance pedestal 9 being adjusted, so that no further lift motion of the built-in appliance is possible. If the limit torque is exceeded, a deflection force $F_A$ occurs between the helical worm spiral 47 and the external gear wheels 46 of the worm wheel 45, with which the drive worm 23 presses in the transverse direction against the spring rib 53. In the event of an overload the spring rib 53 yields elastically, so that the drive worm 23 executes a deflection motion in the direction of arrow I from its operating position, in other words that the worm spiral 47 skips the external teeth 46 of the worm wheel 45 by one pitch. This skipping is perceived as a juddering, so that a corresponding lift actuation of the rear central appliance pedestal 9 can be stopped.

As emerges from FIG. 4, the compensation motion I of the drive worm 23 occurs in a transverse direction to the axis of rotation 51 of the worm wheel 45. Likewise the slot 41, in which the bearing pin 39 of the drive worm 23 is mounted, extends in the transverse direction. The top and bottom longitudinal edges 55 of the slot 41 act here as a height stop, with which the deflecting motion I of the drive worm 23 is reliably guided in the direction of the spring rib 53.

LIST OF REFERENCE CHARACTERS

1 Mounting base
3 Household appliance
5 Support arm
7 Front appliance pedestal
9 Rear appliance pedestal
11 Height-adjusting device
13 Adjusting rod
15 Front of the mounting base 1
17 Adjusting bush
19 Bearing opening
21 Tool kit
23 Drive gear, drive worm
25 Transmission drive
27 Gear case
29 Worm case
31 Shank housing
33 Threaded shank
35 Flat area
37 Shank channel
39 Bearing pin
41 Slot
43 Rear wall of the mounting base
45 Driven gear, worm wheel
46 External gear wheels of the worm wheel
47 Worm spiral
48 Internal thread of the worm wheel
49, 51 Axes of rotation
53 Torque-limiting element
55 Height stop

The invention claimed is:

1. A household appliance, comprising: an appliance pedestal; and a height-adjusting device for adjusting a height of the appliance pedestal, the height-adjusting device including a drive gear structured to engage with a transmission drive converting a rotational motion of the drive gear into a lift motion of the appliance pedestal, wherein the height-adjusting device includes a torque-limiting element operable to enable a deflecting motion of the drive gear from an operating position when a limit torque is exceeded and which releases the engagement between the drive gear and the transmission drive when the limit torque is exceeded, and the torque-limiting element enables the deflecting motion at all positions of height adjustment of the height-adjusting device.

2. The household appliance as claimed in claim 1, wherein the drive gear is structured to press against the torque-limiting element with a deflecting force which arises when torque is transmitted.

3. The household appliance as claimed in claim 1, wherein the torque-limiting element is structured to be elastically deflected.

4. The household appliance as claimed in claim 1, wherein the torque-limiting element is a housing section of a housing in which the drive gear is rotatably mounted.

5. The household appliance as claimed in claim 1, wherein the torque-limiting element is structured to be brought into contact with a gear wheel outer contour of the drive gear.

6. The household appliance as claimed claim 1, wherein the drive gear is a worm gear structured to engage with a worm wheel, and wherein an axis of rotation of the worm gear lies perpendicular to an axis of rotation of the worm wheel.

7. The household appliance as claimed in claim 1, wherein a material of the torque-limiting element is at least one of a same material and in one piece with a mounting base of the household appliance.

8. The household appliance as claimed in claim 7, wherein the mounting base and the torque-limiting element include plastic injection-molded parts.

9. The household appliance as claimed in claim 1, wherein the drive gear is disposed in a rotationally fixed manner on an adjusting rod.

10. The household appliance as claimed in claim 6, wherein the deflecting motion of the drive gear is in a transverse direction to the axis of rotation of the worm wheel.

11. The household appliance as claimed in claim 6, further comprising a height stop that guides the drive gear so that the deflecting motion is in a direction of the torque-limiting element.

12. The household appliance as claimed in claim 11, wherein the worm gear is extended with a bearing pin which is guided in a bearing opening.

13. The household appliance as claimed in claim 1, wherein the torque-limiting element is a spring rib.

14. A household appliance, comprising:

an appliance pedestal; and a height-adjusting device having a drive gear;

a transmission drive that, in an operating position, engages the drive gear and converts a rotational motion of the drive gear into a lift motion of the appliance pedestal; and a torque-limiting element operable to enable a deflecting motion of the drive gear from the operating position when a limit torque is exceeded, the deflecting motion releasing the engagement between the drive gear and the transmission drive when the limit torque is exceeded, wherein the torque-limiting element enables the deflecting motion at all positions of height adjustment of the height-adjusting device.

15. The household appliance as claimed in claim 14, wherein the drive gear is structured to press against the torque-limiting element with a deflecting force which arises when torque is transmitted.

16. The household appliance as claimed in claim 14, wherein the torque-limiting element is structured to be elastically deflected.

17. The household appliance as claimed in claim 14, wherein the torque-limiting element is a housing section of a housing in which the drive gear is rotatably mounted.

18. The household appliance as claimed in claim 14, wherein the torque-limiting element is structured to be brought into contact with a gear wheel outer contour of the drive gear.

19. The household appliance as claimed claim 14, wherein the drive gear is a worm gear structured to engage with a worm wheel, and wherein an axis of rotation of the worm gear lies perpendicular to an axis of rotation of the worm wheel.

20. The household appliance as claimed in claim 14, wherein the drive gear is disposed in a rotationally fixed manner on an adjusting rod.

21. The household appliance as claimed in claim 19, wherein the deflecting motion of the drive gear is in a transverse direction to the axis of rotation of the worm wheel.

22. The household appliance as claimed in claim 14, wherein the torque-limiting element is a spring rib.

* * * * *